US006892788B2

(12) United States Patent
Schreiner et al.

(10) Patent No.: US 6,892,788 B2
(45) Date of Patent: May 17, 2005

(54) MOULD FOR THE MANUFACTURE OF A CASTING USING MOULDING MATERIAL AND METHOD FOR THE MANUFACTURE OF A MOULD

(75) Inventors: Jens Schreiner, Recklinghausen (DE); Andreas Flesch, Arnstadt (DE)

(73) Assignee: Deutsche Giesserei- und Industrie-Holding AG, Essen (DE)

( * ) Notice: Subject to any disclaimer, the term of this patent is extended or adjusted under 35 U.S.C. 154(b) by 42 days.

(21) Appl. No.: 10/434,356

(22) Filed: May 9, 2003

(65) Prior Publication Data

US 2004/0003910 A1 Jan. 8, 2004

(30) Foreign Application Priority Data

May 10, 2002 (DE) ..... 102 21 074

(51) Int. Cl.[7] ..... B22C 9/02; B22D 33/04

(52) U.S. Cl. ..... 164/33; 164/137; 164/138; 164/322

(58) Field of Search ..... 164/23, 24, 33, 164/137, 138, 339, 129, 130, 322, 323

(56) References Cited

U.S. PATENT DOCUMENTS 4,620,582 A * 11/1986 Muller-Spath ..... 164/5
5,092,390 A * 3/1992 Witt ..... 164/65
5,213,149 A * 5/1993 Ruff et al. ..... 164/122

FOREIGN PATENT DOCUMENTS

| | | | | |
|---|---|---|---|---|
| DE | 32 10 588 A1 | | 10/1983 | |
| DE | 33 23 697 C1 | | 11/1986 | |
| DE | 38 06 987 C2 | | 9/1989 | |
| DE | 100 32 843 A1 | | 1/2002 | |
| GB | 2 118 079 A | * | 10/1983 | ..... B22C/9/02 |
| JP | 62-220241 A | * | 9/1987 | ..... B22C/9/02 |

OTHER PUBLICATIONS

Patent Abstracts of Japan, vol. 012, No. 078 (M–675), & JP 62 220241 A (Toyota Motor Corp), Sep. 28, 1987.

Patent Abstracts of Japan, vol. 012, No. 48 (M–777), Aug. 26, 1988, JP 63 207445 A (Honda Motor Co Ltd).

* cited by examiner

*Primary Examiner*—Kevin P. Kerns
(74) *Attorney, Agent, or Firm*—Nixon Peabody LLP; David S. Safran

(57) ABSTRACT

A mould (1) for the manufacture of a casting (2) using moulding material (3). In order to achieve simple and cheap manufacture, the mould (1) is provided with an outer first mould carrier (4), an outer second mould carrier (5), a mould body (6) arranged between said mould carriers (4, 5) and an inner layer (12) of moulding material (3) applied to said mould carrier (6) at least in areas, to form the mould cavity.

16 Claims, 4 Drawing Sheets

MOULD FOR THE MANUFACTURE OF A CASTING USING MOULDING MATERIAL AND METHOD FOR THE MANUFACTURE OF A MOULD

BACKGROUND OF THE INVENTION

1. Field of the Invention

The invention relates to a mould for the manufacture of a casting using moulding material and a method for the manufacture of such a mould.

2. Description of Related Art

Castings which frequently have a complex shape are usually manufactured in so-called "dead" moulds or in permanent moulds. During casting in dead moulds which generally consist of a mineral, refractory, granular basic material, such as quartz sand or chrome ore sand as well as a binder and frequently also other additives to improve the properties of the moulding material, the mould is destroyed by the unpacking process after the casting. In connection with casting in dead moulds, a model of the casting is first made of metal, wood, gypsum or plastic. The model forms the outer contour of the base piece. The model is basically re-usable. In order to produce the mould, the upper and lower part of the model is positioned in a mould box, i.e. an upper box and a lower box, and surrounded by the moulding material. After compacting and hardening the moulding material, the model parts are withdrawn from the sand mould. The upper and lower boxes are then placed one above the other. The negative mould is thus completed.

Casting using dead moulds is used especially for Fe-based high-melting alloys. A disadvantage with casting using dead moulds is that after each casting process not only a new mould must be produced but the re-processing or removal of the moulding material after casting is associated with a high installation and financial expenditure. It is especially important in this connection that the mould boxes for the manufacture of the moulds usually have a standard shape so that a relatively large quantity of moulding material is required for small castings in order to be able to produce the mould.

A further disadvantage during casting using dead moulds is that cooling segments cannot be positioned exactly. Cooling segments are usually used in a dead mould to create a temperature gradient and to set a guided solidification. Beginning from the "end zone" of a casting, the feed flux to the "feeder zone" is hereby facilitated. Cooling segments are placed loosely on the model in the respective box and fixed by the moulding material which surrounds them. During the compaction of the moulding material the exact position of the cooling segment can be lost. However, the exact positioning of cooling segments is of considerable importance in the casting of thin-walled castings.

During casting in permanent moulds hundreds to hundreds of thousands of castings can be achieved using the same moulding device. Permanent moulds have become exceptionally important for the comparatively low-melting non-ferrous metal cast work-pieces since the thermal stressing which imposes limits on the permanent moulds is acceptable because of the relatively low casting temperatures for non-ferrous metals. Cast iron work-pieces and steel can fundamentally also be cast in permanent moulds but the associated costs for the production and maintenance caused by the moulding materials used (e.g. graphite, sintered metals, ceramic materials) are very high. Permanent moulds suitable for the casting of cast iron work-pieces and steel are thus very expensive and very liable to wear as a result of the high thermal loading of the cracks forming in some parts or as a result of the local melting of the mould.

SUMMARY OF THE INVENTION

The object of the present invention is thus to provide a mould and a method for the manufacture of a mould whereby cast iron work-pieces and steel can be cast simply and cheaply.

The aforesaid object is solved according to the invention by a mould which has an outer first mould carrier and an outer second mould carrier, wherein a mould body is provided between said mould carriers and wherein there is provided on the mould body at least in part an inner layer of moulding material to form the mould cavity. According to the method, for the manufacture of the mould according to the invention, it is provided in an alternative that the layer thickness of the moulding material is selected depending on the wall thickness of the casting to be cast and/or depending on the solidification behaviour and thus also on the temperature of the melt brought into the mould. In an alternative development, the moulding material is applied pneumatically by means of air pulses onto one half of the mould body affixed to a mould carrier, especially having a modular structure.

Although the mould according to the invention is also a type of a dead mould, there are substantial advantages compared with the prior art. As a result of the mould body arranged between the mould carriers which already at least substantially predetermines the negative mould or the mould cavity, merely a smaller quantity of moulding material is required to produce the actual negative mould. Thus, in contrast to the prior art, a smaller quantity of moulding material is used in each casting process. This is particularly important for thin-walled castings having a wall thickness between 1 and 10 mm. During the casting of such thin-walled castings only a smaller quantity of heat is produced which must be absorbed by the moulding material during the solidification. The binder of the moulding material thus only burns to a depth of a few centimeters. Precisely this circumstance is now used in the invention and accordingly the layer thickness of the applied moulding material is selected depending on the wall thickness of the casting to be cast and/or depending on the solidification behaviour or temperature of the melt brought into the mould. Ultimately in the optimum case, only that quantity of moulding material which is required for casting for technical reasons is hereby necessary. In contrast, in the prior art it is the case for small or thin-walled castings that considerable quantities of moulding material which were inherently still usable after the casting are fed to re-processing. This is not only associated with increased and inherently unnecessary costs for the moulding material but also with high installation expenditure for the re-processing. Higher energy costs are also obtained. In addition, the design of the sand preparation in the foundry is more expensive because of the large quantities of sand involved. Finally, large quantities of dust are produced in the prior art which can not only contaminate the environment but may also incur increased costs for dumping.

The use of the mould body according to the invention however also offers further advantages. Since the mould body which already predetermines the negative basic mould already occupies a large part of the volume between the mould carriers and consequently only small quantities of sand are required to produce a mould, considerably lower cycle times to produce the mould can be achieved.

Furthermore, in the mould according to the invention it is easily possible to affix cooling segments on the mould carrier or on the mould body so that an exact positioning is obtained which, as stated initially, is important for the manufacture of thin-walled castings. In addition it is also quite possible that the mould body—with a suitable choice of material—itself takes on the function of a cooling segment at least in some areas, namely in areas which are not coated or are only coated with a small layer of moulding material.

Short cycle times can be achieved in particular by the fact that the application of the layer of moulding material to the mould body or the individual halves of the mould body is supported by an air flow. The thickness of the sand layer can also easily be adjusted hereby according to the requirements of a guided solidification. After application of the layer, the halves of the mould body are then placed one on the other so that the mould is closed.

It has also been established that when metal and/or ceramic mould carriers and a metal mould body are used, considerable stabilisation of the mould is obtained which is important for the manufacture of thin-walled castings where narrow manufacturing tolerances must be adhered to.

It is of particular advantage in connection with the present invention to construct the mould body in a modular fashion so that this comprises a plurality of mould body segments. As a result of this modular structure, it is easily possible to supplement individual modules and thus predetermine the negative basic mould for the mould cavity. The final negative mould is then formed by the moulding material insofar as this is applied to the mould body.

Preferred developments of the invention are obtained from the dependent claims.

BRIEF DESCRIPTION OF THE DRAWINGS

Preferred embodiments of the invention are described below with reference to the drawings. In the figures

DETAILED DESCRIPTION OF THE INVENTION

Figure 1:
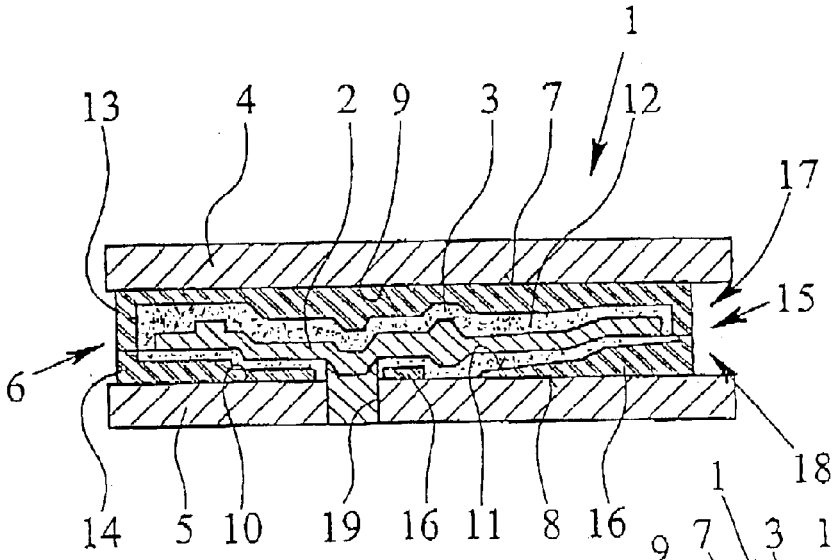
FIG. 1 shows a cross-sectional view of a first embodiment of a mould according to the invention.
Figure 2:
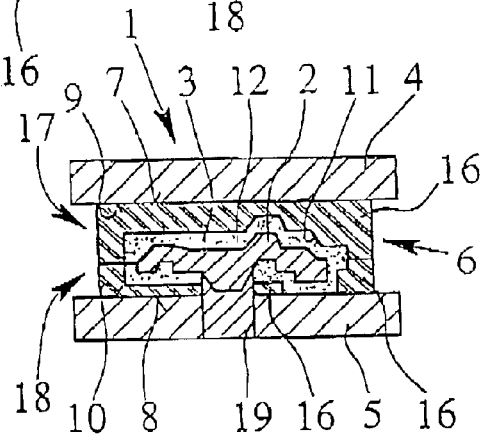
FIG. 2 shows a further cross-sectional view of the mould from FIG. 1.

A mould 1 for the manufacture of a casting 2 using moulding material 3 is shown in each of the figures. The moulding material comprises in an inherently known fashion mineral, refractory, granular material such as sand with binders and if necessary, further additives. As a result of the use of moulding material, the mould 1 basically comprise a mould of the "dead mould" type.

The mould 1 has an outer first mould carrier 4 and an outer second mould carrier 5. Said mould carriers 4 and 5 comprise the upper and lower boundary of the mould 1 in a horizontal arrangement. It is understood that the mould can naturally also be arranged obliquely or vertically. In a vertical arrangement of the mould 1 the mould carriers 4, 5 are also located on the outside but are then arranged on the right and on the left. The following embodiments relate equally to the right-left arrangement of the mould carriers although the top-bottom arrange of the mould carriers is shown and described. The same also applies to the mould body halves 13, 14 described in detail below. Between the mould carriers 4, 5 there is a mould body 6 which usually consists of metal but can also consist of ceramic at least in some areas. The mould body 6 abuts with its outsides 7, 8 on the inner surfaces 9, 10 of the mould carriers 4, 5. The inner surface 11 of the mould body 6 is profiled and corresponds at least substantially to the outer contour of the casting 2. The inner surface 11 of the mould body 6 thus forms a negative blank mould or an outer blank mould. A layer 12 of the moulding material 3 is applied, at least in part, to the inner surface 11 of the mould body 6 to form the casting cavity not described in detail. The layer thickness varies between 0 mm and a maximum of 100 mm and can have any value in between without it being necessary to specify this in detail.

Although the total inner surface of the mould body 6 is coated with moulding material 3 in the individual figures, it may be noted that for reasons of casting technology it is fundamentally also possible not to coat individual surface areas. This will be discussed in further detail below. Besides, in the embodiments shown it is thus the case that the layer 12 of moulding material 3 is partly also applied directly to the inner surface 10 of the lower mould carrier 5. For certain castings 2 this is naturally also possible in the area of the upper mould carrier 4 although this is not shown in the present case.

As can be seen from the individual figures, the mould body 6 has a first mould body half 13 and a second mould body half 14. The upper mould body half 13 is affixed to the upper mould carrier 4 while the lower mould body half 14 is affixed to the lower mould carrier 5. In the closed state of the mould 1 the mould body halves 13, 14 in each case lie one on top of the other in their outer edge region 15 so that the mould 1 is closed in this region.

Figure 11:
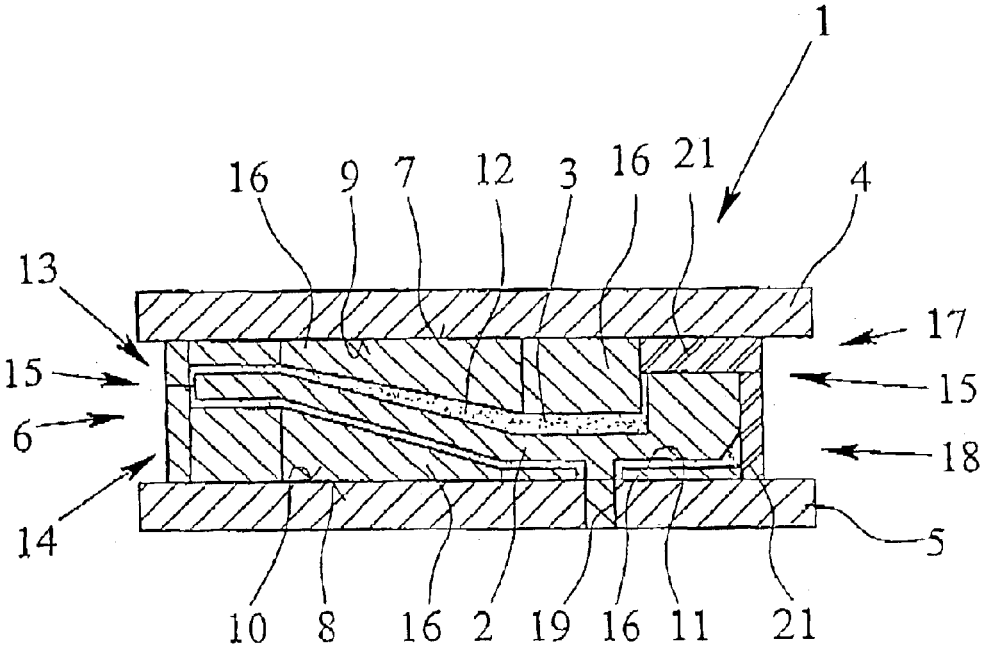
FIG. 11 shows a cross-sectional view of a sixth embodiment of a mould according to the invention.
Figure 12:
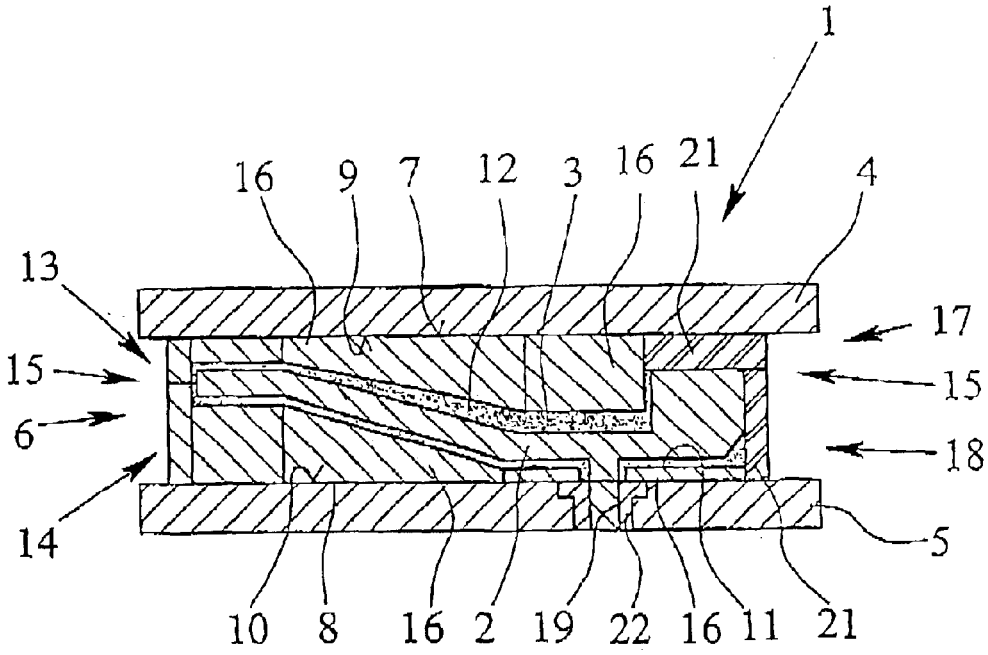
FIG. 12 shows a cross-sectional view of a seventh embodiment of a mould according to the invention.

It can be seen primarily from FIGS. 11 and 12 that the mould body 6 has a plurality of especially modularly constructed mould carrier segments 16. As a result of the modular structure, it is possible to supplement or remove as required individual mould body segments 16 in order to achieve a variation in the thickness of the layer 12 in order to meet the requirements of a guided solidification. In the present case, modular also means that the mould body segments 16 are constructed in a unit construction fashion, i.e., the lengths, widths and/or heights of the individual mould body segments 16 are matched to one another in terms of their dimensions which means that a certain basic dimension n is provided and all the dimensions are an integer-value multiple of the basic dimension n. The individual mould body elements 16 are each securely connected to the respective mould carrier 4, 5. If it is necessary to arrange mould body elements one on top of the other to achieve a certain negative mould or negative blank mould, it is understood that in this case, the relevant mould body elements 16 are affixed one onto the other, especially screwed. Moreover, suitable guide elements such as pins and grooves can be provided on the outsides 7, 8 of the mould body segments 16 and on the inner surfaces 9, 10 of the mould carriers 4, 5 to ensure exact positioning of the individual mould body segments 16 or the mould body halves 13, 14 on the mould carriers 4, 5. As a result of the modular structure of the mould body 6, it is easily possible to provide corresponding continuously matching guide or positioning elements on the relevant components.

In the individual exemplary embodiments the mould body segments 16 are designed as solid blocks. The solid design results in a comparatively high weight both of the upper box 17, which is composed of the upper mould carrier 4, the upper mould body half 13 and the deposited layer 3, and also of the lower box 18 which comprises the lower mould carrier 5, the lower mould body half 14 and the layer 12 deposited thereon. For certain applications a comparatively high weight of the upper box is of advantage in any case. In the exemplary embodiments shown the mould 1 is used for low-pressure casting. The mould 1 is filled from below, i.e., via an opening 19 in the lower mould carrier 5 usually called a gate. As a result of the solid design of the upper mould body half 13 and the resulting high own weight, any "floating up" of the upper box 17 during casting can be prevented. Additional means for holding down the upper box 17 or clamping the mould 1 can be omitted.

It is not shown that the mould body segments 16 on the side facing the respective mould carriers 4, 5 can be provided with cavities, recesses or the like to save weight. A saving in weight can then be achieved hereby provided that this is desired and necessary according to the casting method or application.

Figure 3:
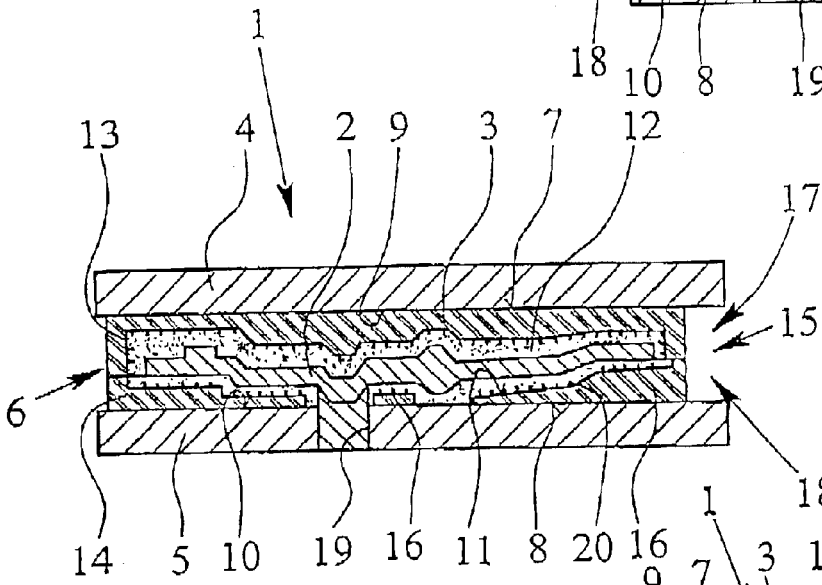
FIG. 3 shows a cross-sectional view of a second embodiment of a mould according to the invention.
Figure 4:
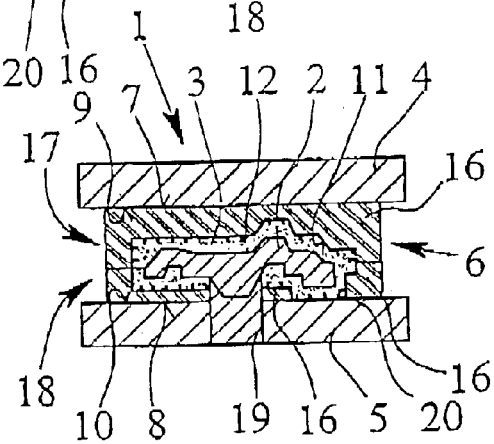
FIG. 4 shows a further cross-sectional view of the mould from FIG. 3.

In the embodiment shown in FIGS. 3 and 4 it is the case that fixing aids 20 are provided on the mould body 6 on the inner surface 11, i.e., on the side facing the moulding material 3 to prevent unintentional detachment of the moulding material 3 from the mould body 6. Said fixing aids 20 are, for example, projections in the fashion of fastening irons which should prevent any detachment of mould sand as a result of vibrations which occur during operation of the foundry. Instead of fastening irons it is fundamentally also possible to provide fixing aids in the form of surface profiling of the inner surface 11 of the mould body 6 in order to achieve better binding of the moulding material 3 to the mould body 6.

The mould body 6 itself or the individual mould body segments 16 preferably consist of a refractory material, such as especially graphite, tungsten carbide or steel. Such a choice of material is usually required since the mould body 6 is subjected to high thermal stressing during casting. In contrast, the mould carriers 4, 5 can be made of more favourable materials since the thermal loading of these components is generally considerably lower.

In the embodiments shown in FIGS. 11 and 12 a cooling segment 21 is affixed to both the upper mould carrier 4 and to the lower mould carrier 5. As a result of the direct fixing of the cooling segments 21 to the mould carriers 4, 5, these segments are positioned exactly, which is of considerable importance with regard to a guided solidification specifically in the case of thin-walled castings. The cooling segments 21 are characterized in that no layer 12 of moulding material 3 is applied to them at least in some areas and thus thermal energy can be removed very rapidly via the cooling segments 21. Finally, the cooling segments 21 comprise mould body segments 16 to which heat-insulating moulding material 3 is not applied or is only applied in parts.

As can be seen from the individual drawings, the moulding material 3 is applied to the mould body 6 or the inner surface 11 with different layer thickness. In areas where the melt should remain liquid for as long as possible, the layer thickness is greater so that a heat-insulating effect is obtained there. In areas where a large amount of material of the casting 2 is located and/or solidification should take place as quickly as possible, the layer thickness is very small or moulding material 3 has been completely dispensed with in these areas, as is the case in the embodiments according to FIGS. 11 and 12 in the area of the cooling segments 21. In each case, the thickness of the layer 12 can be adjusted according to the requirements of a guided solidification taking into account the wall thickness of the casting 1 to be cast and can thus be optimized.

Even if this is not shown in detail, the moulding material 3 is applied pneumatically and especially by air pulses, i.e. at high speed and at high pressure, to the inner surface 11 of the mould body 6. The moulding material 3 is quasi-shot onto the mould body 6. By this means the desired layer thickness can be achieved exactly and in the shortest time. With regard to this very rapid application of the moulding material 3 onto the mould body 6, openings of small opening width not shown are provided in the mould body for the removal of air during the air-flow-supported application of the moulding material 3. The moulding material 3 is applied fully automatically to the desired layer thickness which is usually in the single-digit centimeter range wherein solidification takes place very rapidly as a result of the binder contained in the moulding material 3. As a result of this type of manufacture of the negative mould, very low cycle times for the manufacture of the mould 1 can be achieved and especially only a very small quantity of moulding material 3 needs to be applied to the mould body 6.

As can be deduced further from the individual figures, the mould carriers 4, 5 are each constructed as plate-shaped as so-called base plates. Ultimately, the base plates merely take over the bearing function for the mould body 6 which can be of arbitrary size but should not project over the base plates. The invention thus offers the possibility of using standardized base plates to which larger or smaller mould bodies 6 can be affixed according to the casting to be manufactured. As a result of the plate-shaped construction of the mould carriers 4, 5, these merely form the upper and lower termination of the mould 1. To the side the mould 1 is bounded by the mould body 6 or the mould body halves 13, 14 lying one on top of the other.

As has already been described, an opening 19 for filling the mould 1 is located in the present case in the lower mould carrier 5. Basically it is also possible to provide a corresponding opening in the upper mould carrier 4 or however, to the side of the mould body 6. The gates are arranged taking into account the selected casting method wherein in addition to low-pressure casting, the mould 1 can fundamentally also be used for centrifugal and pressure casting and also for tilting casting.

In any case, it is possible to provide an insert 22 made of heat-resistant material in the area of the gate and/or a feeder to the mould 1 not shown, as is shown in FIG. 12. The insert can comprise moulding material or however, commercially available insulating materials. It is not shown that the insert 22 can fundamentally also project outwards.

Figure 5:
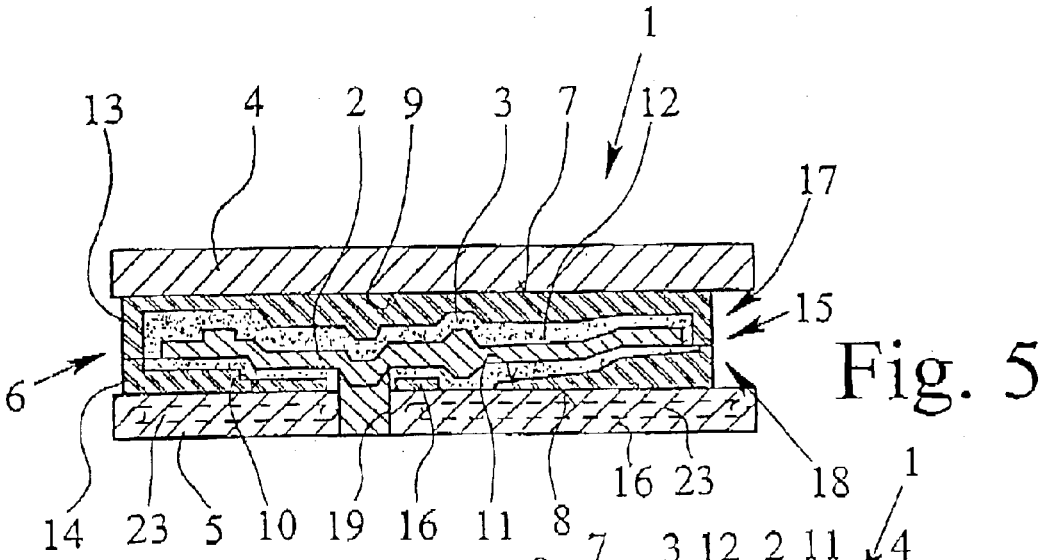
FIG. 5 shows a cross-sectional view of a third embodiment of a mould according to the invention.
Figure 6:
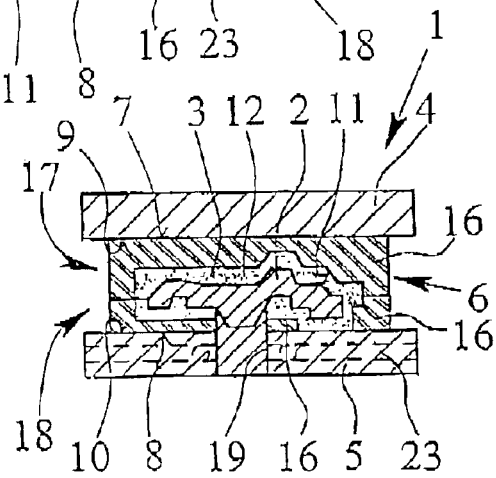
FIG. 6 shows a further cross-sectional view of the mould from FIG. 5.

In the embodiment shown in FIGS. 5 and 6 cooling is provided in the area of the opening 19. Said cooling presently has at least one cooling channel 23 which is directed past the gate and preferably substantially surrounds said gate for the passage of a cooling medium. In the present case, the cooling channel 23 is located in the lower mould carrier 5 so that said carrier and especially the area of the opening 19 is cooled. According to the method, the cooling is activated towards the end of the casting process. The ensuing cooling effect is used to construct a guided solidification or to adjust rapid solidification in the area of the opening 19. Rapid solidification in the area of the opening 19 is required to prevent still liquid metal from escaping from the opening 19 when short cycle times are used. All suitable gaseous or liquid materials can be used as cooling media which are supplied via the cooling channel 23 and preferably guided in the circuit.

In addition it may be noted that the arrangement of the cooling in the area of the opening 19 is also of independent inventive importance, i.e. independently of the realization of the mould body 6 and the layer 12 of moulding material 3 applied thereto.

Figure 7:
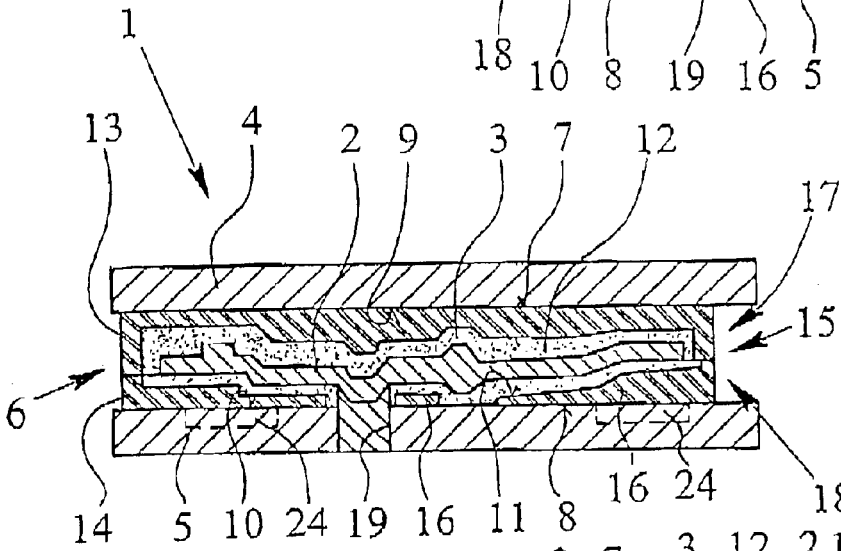
FIG. 7 shows a cross-sectional view of a fourth embodiment of a mould according to the invention.
Figure 8:
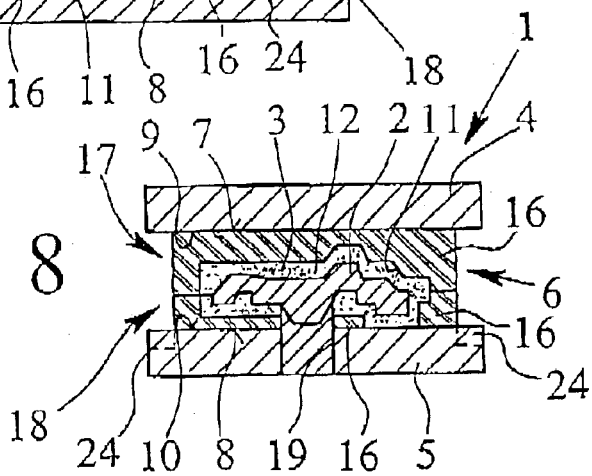
FIG. 8 shows a further cross-sectional view of the mould from FIG. 7.

It is shown in FIGS. 7 and 8 that means for coupling with the allocated casting device are provided on one of the mould carriers, in the present case on the lower mould carrier 5. In the present case, the coupling means are recesses 24 in which corresponding hooks or projections of the casting device engage when the mould 1 is positioned on the casting device. It is understood that it is fundamentally also possible to provide corresponding recesses additionally or merely on the upper mould carrier 4.

Figure 9:
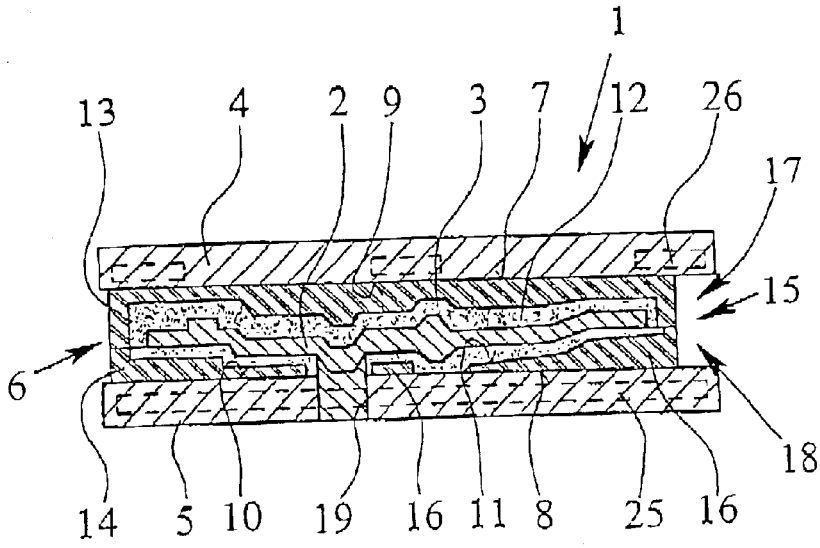
FIG. 9 shows a cross-sectional view of a fifth embodiment of a mould according to the invention.
Figure 10:
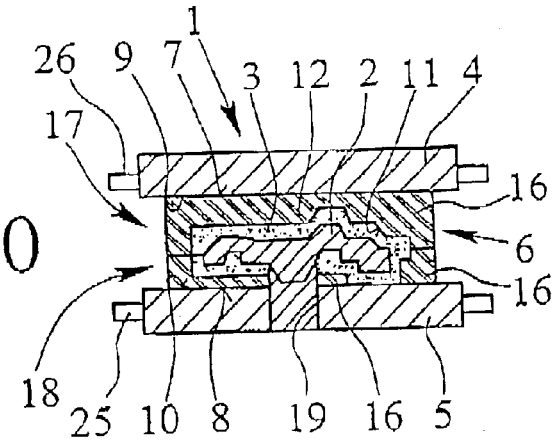
FIG. 10 shows a further cross-sectional view of the mould from FIG. 9.

It is shown in FIGS. 9 and 10 that guide means 25, 26 are provided both on the upper mould carrier 4 and on the lower mould carrier 5 so that the mould carriers 4, 5 can be conveyed and positioned simply. In the embodiment shown the guide means 25 comprises a longitudinally extended guide projection which projects sideways from the lower mould carrier 5 while the guide means 26 comprises a plurality of sideways projecting guide pieces.

A mould 1 is manufactured such that the mould body segments 16 are first placed on the respective mould carriers 4, 5 and are positioned exactly with the aid of corresponding positioning or form-locking means. The mould body segments 16 are then securely connected to the respective mould carriers 4, 5. The moulding material 3 is then applied pneumatically by means of air pulses to the required layer thickness depending on the wall thickness of the casting to be manufactured. The required layer thickness to achieve a guided solidification is incumbent upon the person skilled in the art taking into account his specialist knowledge on the basis of the aforesaid parameters. It basically holds that in areas where solidification should take place as late as possible, a large layer thickness is selected whereas in areas where the melt should solidify rapidly, a very small layer thickness as far as no layer thickness should be present. In cases where the melt comes directly in contact with cooling segments 21 or mould body segments 16, a combination of metal permanent mould and dead mould is ultimately obtained. After application of the layer 12, the mould body halves 13, 14 are placed one on top of the other so that the mould 1 is closed and melt can be inserted.

What is claimed is:

1. A mould (1) for the manufacture of a casting (2) using moulding material (3), comprising an outer first mould carrier (4), a mould body (6) and an inner layer (12) of moulding material (3) applied to said mould body (6) at least in areas, to form the mould cavity, characterized in that the mould (1) comprises an outer second mould carrier (5), that the mould body (6) is arranged between said mould carriers (4, 5), that the mould body (6) has a first mould body half (13) affixed to the first mould carrier (4) and a second mould body half (14) affixed to the second mould carrier (5) and the mould body halves (13, 14) lie one on top of the other in the closed state of the mould (1), that the first mould carrier (4) and the second mould carrier (5) are constructed as a base plate, and that the mould (1) is bounded by the mould body (6) or the mould body halves (13, 14).

2. The mould according to claim 1 characterized in that the mould body (6) has a plurality of modularly constructed mould body segments (16) especially comprising a refractory material such as especially graphite, tungsten carbide or steel and that preferably mould body segments (16) are provided with recesses or cavities on the side facing the mould carrier (4, 5) or that mould body segments (16) are constructed as solid blocks.

3. The mould according to claim 1, characterized in that fixing aids (20) are provided on the mould body (6) on the side facing the moulding material (3) to prevent any unintentional detachment of the moulding material (3) from the mould body (6).

4. The mould according to claim 3, characterized in that at least one cooling segment (21) is attached to the first mould carrier (4), the second mould carrier (5) and/or the mould body (6).

5. The mould according to claim 4, characterized in that form-locking means are provided between the mould carriers (4, 5) and the mould body (6) for exact positioning.

6. The mould according to claim 5, characterized in that the moulding material (3) is applied to the mould body (6) with different layer thickness.

7. The mould according to claim 6, characterized in that the moulding material (3) is applied pneumatically to the mould, body (6) by means of air pulses and that preferably, openings of small opening width are provided in the mould body (6) to remove air during air-flow-supported application of the moulding material (3).

8. The mould according to claim 7, characterized in that at least one opening (19) is provided on one of the mould carriers (4, 5) as a gate for filling the mould (1), that preferably an insert (22) made of refractory material is inserted in the opening (19), that preferably cooling is provided in the mould carrier (4, 5) in the area of the opening (19), that preferably the cooling has at least one cooling channel (23) guided past the opening (19) for the passage of a cooling medium.

9. The mould according to claim 8, characterized in that means for coupling to an allocated casting device are provided on at least one mould carrier (4, 5) and/or guide means (25, 26) for conveying and/or positioning the mould (1) and/or the mould carriers (4, 5) are provided.

10. A use of the mould (1) according to claim 1, for centrifugal, low-pressure, pressure and tilting casting.

11. The mould according to claim 1, characterized in that at least one cooling segment (21) is attached to the first mould carrier (4), the second mould carrier (5) and/or the mould body (6).

12. The mould according to claim 1, characterized in that form-locking means are provided between the mould carriers (4, 5) and the mould body (6) for exact positioning.

13. The mould according to claim 1, characterized in that the moulding material (3) is applied to the mould body (6) with different layer thickness.

14. The mould according to claim 1, characterized in that the moulding material (3) is applied pneumatically to the mould body (6) by means of air pulses and that preferably, openings of small opening width are provided in the mould body (6) to remove air during air-flow-supported application of the moulding material (3).

15. The mould according to claim 1, characterized in that at least one opening (19) is provided on one of the mould carriers (4, 5) as a gate for filling the mould (1), that preferably an insert (22) made of refractory material is inserted in the opening (19), that preferably cooling is provided in the mould carrier (4, 5) in the area of the opening (19), that preferably the cooling has at least one cooling channel (23) guided past the opening (19) for the passage of a cooling medium.

16. The mould according to claim 1, characterized in that means for coupling to an allocated casting device are provided on at least one mould carrier (4, 5) and/or guide means (25, 26) for conveying and/or positioning the mould (1) and/or the mould carriers (4, 5) are provided.

* * * * *